US010739697B2

(12) United States Patent
Ogasawara

(10) Patent No.: US 10,739,697 B2
(45) Date of Patent: Aug. 11, 2020

(54) DEVELOPING DEVICE AND IMAGE FORMING APPARATUS

(71) Applicant: TOSHIBA TEC KABUSHIKI KAISHA, Shinagawa-ku, Tokyo (JP)

(72) Inventor: Masato Ogasawara, Katsushika Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/516,559

(22) Filed: Jul. 19, 2019

(65) Prior Publication Data

US 2020/0125002 A1 Apr. 23, 2020

(30) Foreign Application Priority Data

Oct. 18, 2018 (JP) ..... 2018-196655

(51) Int. Cl.
*G03G 15/08* (2006.01)

(52) U.S. Cl.
CPC ..... *G03G 15/0806* (2013.01); *G03G 15/0896* (2013.01); *G03G 15/0898* (2013.01); *G03G 2215/0634* (2013.01); *G03G 2215/0872* (2013.01)

(58) Field of Classification Search
CPC ..... G03G 15/0806; G03G 15/0896; G03G 15/0898; G03G 2215/0634; G03G 2215/0872
See application file for complete search history.

(56) References Cited

U.S. PATENT DOCUMENTS

| | | | | |
|---|---|---|---|---|
| 4,800,411 | A * | 1/1989 | Tanaka | G03G 15/0898 399/103 |
| 5,682,578 | A * | 10/1997 | Shehata | G03G 15/0898 399/355 |
| 9,195,168 | B2 * | 11/2015 | Ishii | G03G 15/0896 |
| 9,244,376 | B2 | 1/2016 | Kuramoto et al. | |
| 10,496,010 | B2 * | 12/2019 | Kuramoto | G03G 15/0887 |
| 10,496,012 | B1 * | 12/2019 | Kuramoto | G03G 15/0921 |
| 2014/0270838 | A1 * | 9/2014 | Yoshizawa | G03G 15/0893 399/99 |
| 2015/0010323 | A1 * | 1/2015 | Okuma | G03G 15/0942 399/104 |
| 2015/0016848 | A1 * | 1/2015 | Ishii | G03G 15/0896 399/279 |

(Continued)

*Primary Examiner* — Ryan D Walsh
(74) *Attorney, Agent, or Firm* — Amin, Turocy & Watson, LLP

(57) ABSTRACT

A developing device according to an embodiment includes a housing, a developing roller, a gap forming member, and a guide section. The gap forming member forms a first gap between the gap forming member and the developing roller. The gap forming member forms a second gap between the gap forming member and the housing. The second gap includes an upstream side opening on a rotating direction upstream side of the developing roller. The guide section directs an air current discharged from the second gap via the upstream side opening to the first gap. A relation of H1/H2<5 is satisfied, where H1 is a minimum interval between the developing roller and the gap forming member in the first gap and H2 is a minimum interval between the housing and the gap forming member in the second gap when viewed from an axial direction of the developing roller.

16 Claims, 14 Drawing Sheets

(56) References Cited

U.S. PATENT DOCUMENTS

| | | | | |
|---|---|---|---|---|
| 2015/0093139 | A1* | 4/2015 | Kuramoto | G03G 15/0806 399/92 |
| 2016/0306291 | A1* | 10/2016 | Kuroda | G03G 15/0844 |
| 2017/0205731 | A1* | 7/2017 | Takahashi | G03G 15/0928 |
| 2017/0212448 | A1* | 7/2017 | Fujimori | G03G 15/081 |
| 2018/0267427 | A1* | 9/2018 | Kuramoto | G03G 15/0822 |
| 2018/0284641 | A1* | 10/2018 | Soeta | G03G 15/0815 |
| 2018/0284655 | A1* | 10/2018 | Hori | G03G 15/0865 |
| 2018/0284656 | A1* | 10/2018 | Takahashi | G03G 15/0808 |
| 2019/0018336 | A1 | 1/2019 | Ogasawara et al. | |
| 2019/0018345 | A1 | 1/2019 | Ogasawara et al. | |
| 2019/0018346 | A1 | 1/2019 | Ogasawara et al. | |
| 2019/0294077 | A1* | 9/2019 | Kuramoto | G03G 15/0865 |
| 2020/0019086 | A1 | 1/2020 | Ogasawara et al. | |

* cited by examiner

DEVELOPING DEVICE AND IMAGE FORMING APPARATUS

CROSS-REFERENCE TO RELATED APPLICATION

This application is based upon and claims the benefit of priority from Japanese Patent Application No. 2018-196655, filed Oct. 18, 2018, the entire contents of which are incorporated herein by reference.

FIELD

Embodiments described herein relate generally to a developing device and an image forming apparatus and methods associated therewith.

BACKGROUND

There have been image forming apparatuses such as a multi function peripheral (hereinafter referred to as "MFP") and a printer. The image forming apparatus includes a developing device that stores a developer. The developing device includes a developing roller. If air enters the developing device according to rotation of the developing roller, pressure in the developing device rises. If the pressure in the developing device rises, the air including toner in the developing device sometimes blows out to the outside of the developing device. If the air including the toner blows out to the outside of the developing device, the toner scatters to the outside of the developing device. Functional components such as a charger are likely to be stained.

DETAILED DESCRIPTION

Figure 1:
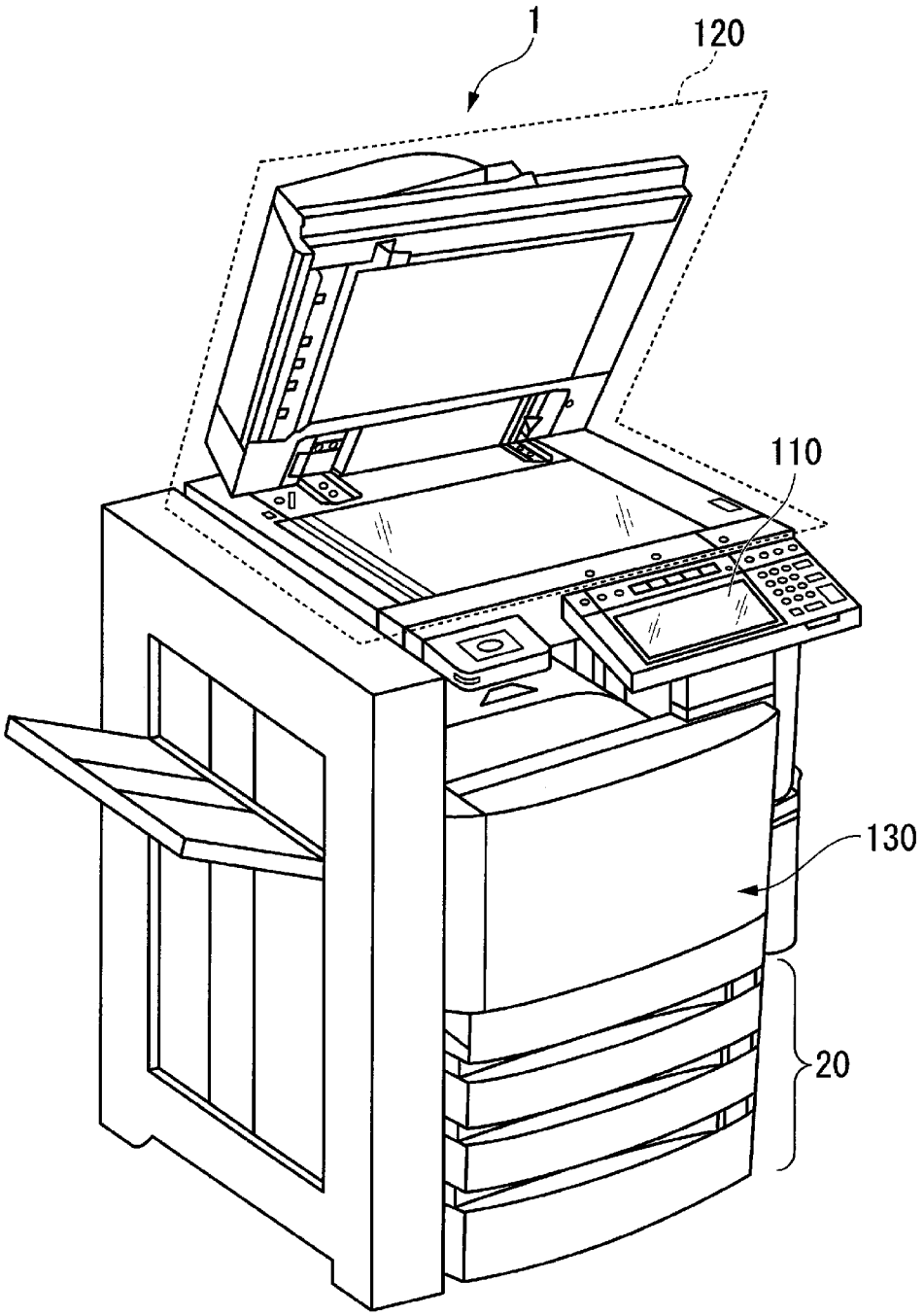
FIG. 1 is an exterior view illustrating an example of an image forming apparatus according to an embodiment.

An object of embodiments is to provide a developing device and an image forming apparatus that can suppress scattering of toner to the outside of the developing device.

A developing device according to an embodiment includes a housing, a developing roller, a gap forming member, and a guide section. The developing roller is rotatably provided on an inside of the housing. The developing roller includes a development pole. The developing roller performs development by a developer carried by a magnetic force of the development pole. The gap forming member is provided on a rotating direction downstream side of the developing roller with respect to the development pole. The gap forming member forms a first gap between the gap forming member and the developing roller. The gap forming member forms a second gap between the gap forming member and the housing. The second gap includes an upstream side opening on a rotating direction upstream side of the developing roller. The guide section is provided further on the rotating direction upstream side of the developing roller than the gap forming member. The guide section directs an air current discharged from the second gap via the upstream side opening to the first gap. A relation of $H1/H2<5$ is satisfied, where H1 is a minimum interval between the developing roller and the gap forming member in the first gap and H2 is a minimum interval between the housing and the gap forming member in the second gap when viewed from an axial direction of the developing roller.

A developing device and an image forming apparatus according to an embodiment are explained below with reference to the drawings. In the figures, the same components are denoted by the same reference numerals and signs.

First Embodiment

FIG. 1 is an exterior view illustrating an example of an image forming apparatus 1 according to an embodiment.

As illustrated in FIG. 1, for example, the image forming apparatus 1 is a multi function peripheral (MFP). The image forming apparatus 1 reads an image formed on a sheet-like recording medium (hereinafter referred to as "sheet") such as paper and generates digital data (an image file). The image forming apparatus 1 forms an image on the sheet using toner based on the digital data.

The image forming apparatus 1 includes a display section 110, an image reading section 120, and an image forming section 130.

The display section 110 operates as an output interface and performs display of characters and images. The display section 110 operates as an input interface as well and receives an instruction from a user. For example, the display section 110 is a liquid crystal display of a touch panel type.

For example, the image reading section 120 is a color scanner. As the color scanner, there are a contact image sensor (CIS), a charge coupled device (CCD), and the like. The image reading section 120 reads an image formed on a sheet using a sensor and generates digital data.

The image forming section 130 forms an image on a sheet using toner. The image forming section 130 forms an image based on image data read by the image reading section 120 or image data received from an external apparatus. For example, the image formed on the sheet is an output image called hardcopy, printout, or the like.

Figure 2:
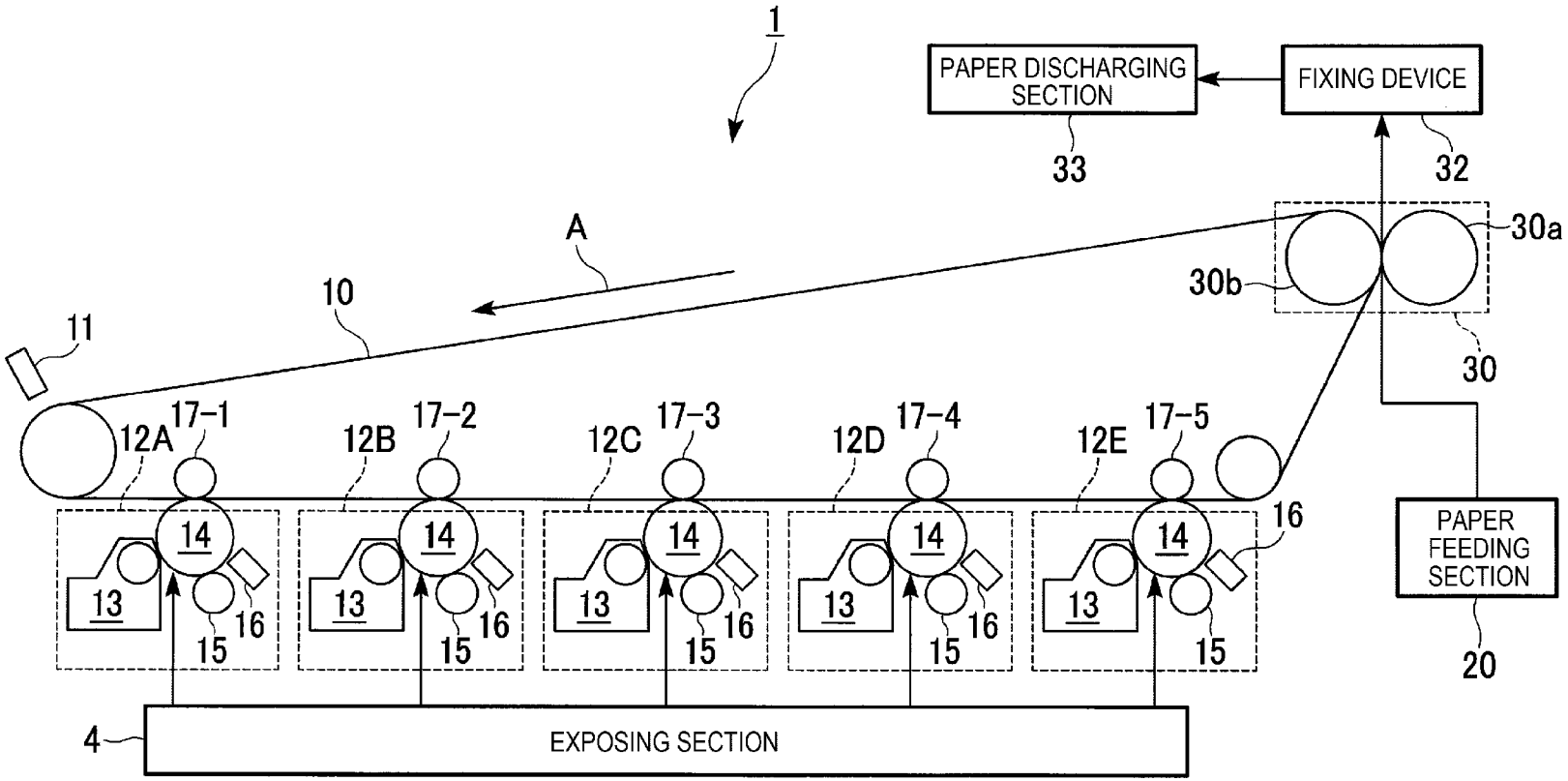
FIG. 2 is a diagram illustrating an example of a schematic configuration of the image forming apparatus.

FIG. 2 is a diagram illustrating an example of a schematic configuration of the image forming apparatus 1 according to the embodiment.

As illustrated in FIG. 2, the image forming apparatus 1 is an image forming apparatus of an electrophotographic system. The image forming apparatus 1 is an image forming apparatus of a quintuple tandem type.

The image forming apparatus 1 includes an exposing section 4, an intermediate transfer body 10, a cleaning blade 11, imaging sections 12A to 12E, primary transfer rollers 17-1 to 17-5, a paper feeding section 20, a secondary transfer section 30, a fixing device 32, and a paper discharging section 33. In the following explanation, if the primary transfer rollers 17-1 to 17-5 are not distinguished, the primary transfer rollers 17-1 to 17-5 are simply described as primary transfer roller(s) 17. If the imaging sections 12A to 12E are not distinguished, the imaging sections 12A to 12E are simply described as imaging section(s) 12.

Transfer in the image forming apparatus 1 includes a first transfer process and a second transfer process. In the first transfer process, the primary transfer rollers 17 transfer images by toners on photoconductive drums 14 of the imaging sections 12 onto the intermediate transfer body 10. In the second transfer process, the secondary transfer section 30 transfers the image onto a sheet using toners of colors laminated on the intermediate transfer body 10.

The exposing section 4 irradiates light on the photoconductive drums 14 of the imaging sections 12 (exposes the photoconductive drums 14 to light). The exposing section 4 includes an exposure light source such as a laser or an LED.

The intermediate transfer body 10 is an endless belt. The intermediate transfer body 10 rotates in an arrow A direction in FIG. 2. An image of toner is formed on the surface of the intermediate transfer body 10.

The cleaning blade 11 removes the toner adhering on the intermediate transfer body 10. For example, the cleaning blade 11 is a tabular member. For example, the cleaning blade 11 is formed of a resin material such as polyurethane.

The imaging sections 12A to 12E form images using toners of colors (five colors in the example illustrated in FIG. 2). The imaging sections 12A to 12E are set in order along the intermediate transfer body 10.

The primary transfer rollers 17 are used in transferring the images by the toners formed by the imaging sections 12A to 12E onto the intermediate transfer body 10.

The paper feeding section 20 feeds a sheet used for image output.

The secondary transfer section 30 includes a secondary transfer roller 30*a* and a secondary transfer counter roller 30*b*. The secondary transfer section 30 transfers the images by the toners formed on the intermediate transfer body 10 onto a sheet. In the secondary transfer section 30, the intermediate transfer body 10 and the secondary transfer roller 30*a* are in contact with each other.

The fixing device 32 fixes, with heating and pressurization, the images by the toners transferred onto the sheet. The sheet, on which an image is formed by the fixing device 32, is discharged to the outside of the apparatus from the paper discharging section 33.

The imaging sections 12 are explained. The imaging sections 12A to 12D respectively store toners of colors corresponding to four colors for color printing. The four colors for color printing are yellow (Y), magenta (M), cyan (C), and black (K). The toners of the four colors for color printing are non-decoloring toners. The imaging section 12E stores decoloring toner. The decoloring toner has a characteristic of decoloring with an external stimulus. "Decolor" means making an image formed in a color (including not only a chromatic color but also achromatic colors such as white and black) different from a color of a base of paper visually invisible. The imaging sections 12A to 12D and the imaging section 12E store different toners but have the same configuration.

The imaging section 12 includes a developing device 13, the photoconductive drum 14, a charger 15, and a cleaning unit 16.

The developing device 13 stores a developer. The developer includes toner. The developing device 13 causes the toner to adhere to the photoconductive drum 14. For example, the toner is used as a one-component developer or is combined with a carrier, which is a magnetic body, and used as a two-component developer. For example, as the carrier, iron powder having a particle diameter of several tens micrometers or polymer ferrite particles are used. In the embodiment, a two-component developer including non-magnetic toner is used.

The photoconductive drum 14 is one of specific examples of an image bearing body. The photoconductive drum 14 includes a photoconductive body on the outer circumferential surface of the photoconductive drum 14. For example, the photoconductive body is an organic photoconductor (OPC).

The charger 15 uniformly charges the surface of the photoconductive drum 14.

The cleaning unit 16 removes toner adhering on the photoconductive drum 14.

The developing device 13 is explained in detail.

Figure 3:
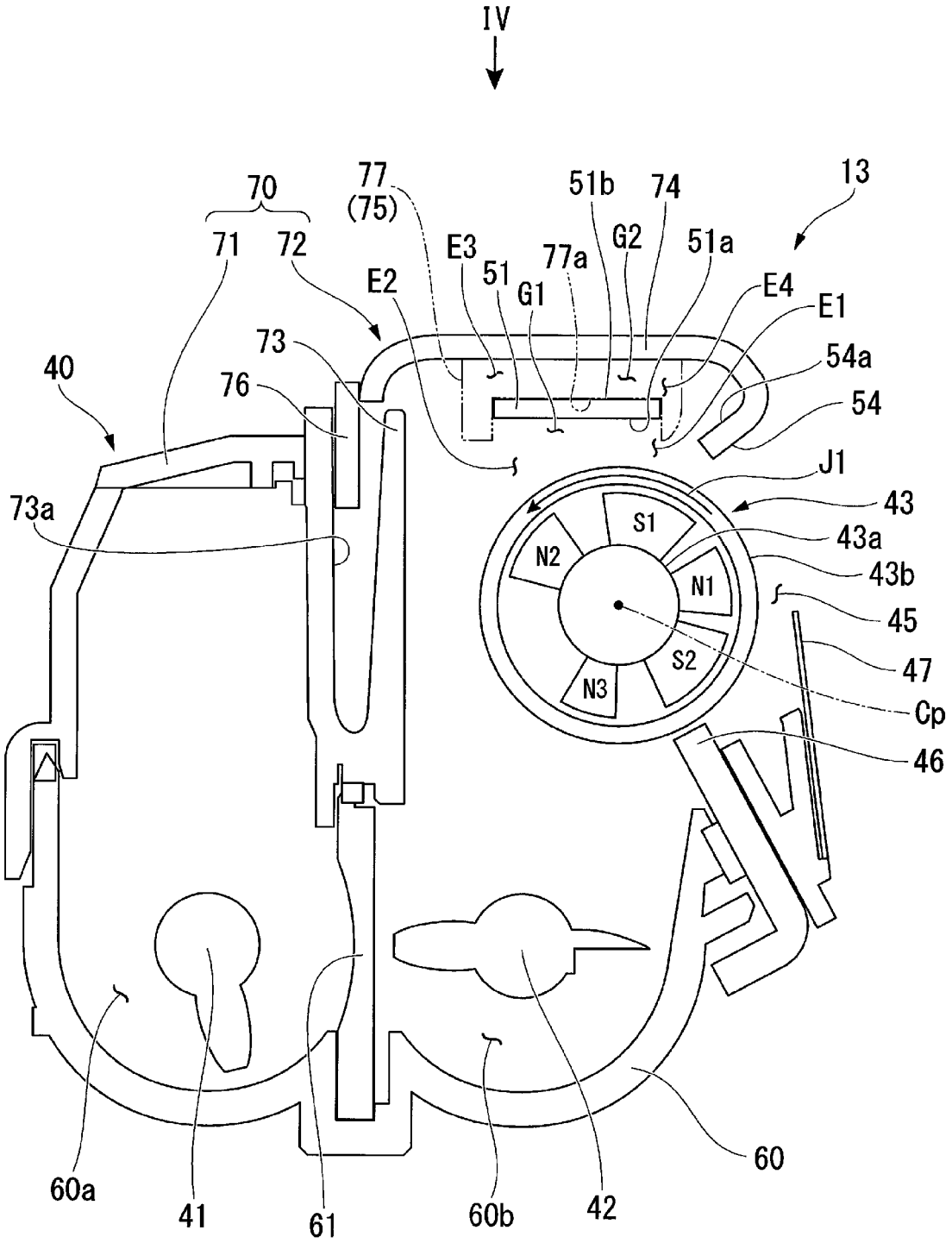
FIG. 3 is a sectional view illustrating a developing device according to the embodiment.

FIG. 3 is a sectional view illustrating the developing device 13 according to the embodiment. In FIG. 3, cross section hatching is omitted. In FIG. 3, a rib 77 explained below is indicated by an imaginary line.

As illustrated in FIG. 3, the developing device 13 includes a housing 40, a first mixer 41, a second mixer 42, a developing roller 43, a gap forming member 51, and a guide section 54.

The housing 40 includes a hollow. The first mixer 41, the second mixer 42, the developing roller 43, and the gap forming member 51 are held on the inside of the housing 40. An opening section 45 facing the photoconductive drum 14 (see FIG. 2) is formed in the housing 40. The opening section 45 exposes a part of the developing roller 43 to the outside of the housing 40. The housing 40 includes a developer storing section 60 and a cover 70.

The developer storing section 60 is formed in a concave shape opened upward. The developer storing section 60 stores a developer. A first groove section 60*a* and a second groove section 60*b* opened upward are formed on the inside of the developer storing section 60. The groove sections 60*a* and 60*b* extend in parallel to each other. A partition wall 61 is provided in a boundary between the groove sections 60*a* and 60*b*.

Figure 4:
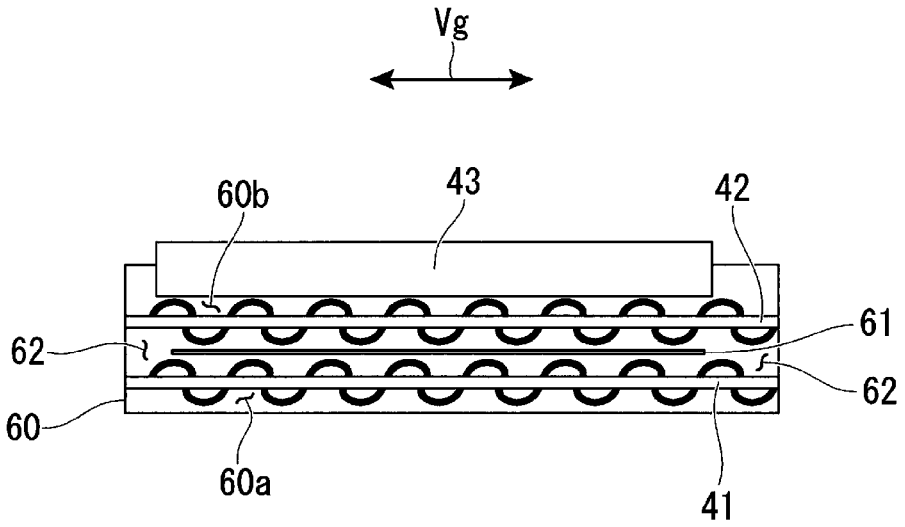
FIG. 4 is an IV arrow view of FIG. 3.

FIG. 4 is a IV arrow view of FIG. 3. In FIG. 4, illustration of the gap forming member 51 and the like is omitted.

As illustrated in FIG. 4, openings 62, which cause the inside of the first groove section 60*a* and the inside of the second groove section 60*b* to communicate, are formed in the partition wall 61. The openings 62 are respectively formed at both ends of the partition wall 61 in an extending direction of the groove sections 60*a* and 60*b*. The openings 62 circulate a developer between the inside of the first groove section 60*a* and the inside of the second groove section 60*b*.

The first mixer 41 is disposed inside the first groove section 60*a*. The second mixer 42 is disposed inside the second groove section 60*b*. The first mixer 41 and the second mixer 42 are disposed in parallel to each other. The first mixer 41 functions as a developer agitating section that agitates a developer. The second mixer 42 functions as a developer supplying section that supplies the developer to the developing roller 43.

As illustrated in FIG. 3, the developing roller 43 is disposed above the second mixer 42. The developing roller 43 is supported by the housing 40. The developing roller 43 carries the developer with a magnetic force of a magnetic body. The developing roller 43 is disposed in parallel to the first mixer 41 and the second mixer 42. The developing roller 43 is opposed to the photoconductive drum 14 (see FIG. 2). The developing roller 43 is disposed along an opening of the second groove section 60*b*. In the following explanation, the axial direction of the developing roller 43 is referred to as "roller axial direction Vg".

The developing roller 43 includes a shaft section 43*a*, a plurality of magnetic pole sections N1, S1, N2, N3, and S2, and a sleeve 43*b*. The shaft section 43*a* and the plurality of magnetic pole sections N1, S1, N2, N3, and S2 are provided to be incapable of relatively rotating with respect to the housing 40. The sleeve 43*b* is provided to be capable of rotating in a direction indicated by an arrow J1 in FIG. 3 with respect to the shaft section 43*a* and the plurality of magnetic pole sections N1, S1, N2, N3, and S2. In the following explanation, the rotating direction of the sleeve 43*b* (a rotating direction of the developing roller 43) is referred to as "roller rotating direction J1".

The shaft section 43*a* extends in the roller axial direction Vg. Both end portions of the shaft section 43*a* are fixed to the housing 40.

The plurality of magnetic pole sections N1, S1, N2, N3, and S2 are fixed to the shaft section 43*a*. The plurality of magnetic pole sections N1, S1, N2, N3, and S2 are fixed in home positions at intervals in the circumferential direction of the shaft section 43*a*. For example, the plurality of magnetic pole sections N1, S1, N2, N3, and S2 are magnets. The plurality of magnetic pole sections N1, S1, N2, N3, and S2 are a development pole N1, a first conveyance pole S1, a peeling pole N2, a grasping pole N3, and a second conveyance pole S2. The development pole N1 is opposed to the photoconductive drum 14 across the sleeve 43*b* to bring the developer carried on the developing roller 43 close to the photoconductive drum 14. The plurality of magnetic pole sections N1, S1, N2, N3, and S2 are disposed in the order of the first conveyance pole S1, the peeling pole N2, the grasping pole N3, and the second conveyance pole S2 downstream in the roller rotating direction J1 with respect to the development pole N1. The development pole N1, the peeling pole N2, and the grasping pole N3 are N poles. The first conveyance pole S1 and the second conveyance pole S2 are S poles.

The first conveyance pole S1 is located on the downstream side in the roller rotating direction J1 with respect to a position where the developing roller 43 is oppose to the photoconductive drum 14. The first conveyance pole S1 is located in a most upstream section in the roller rotating direction J1 on the inside of the housing 40.

The sleeve 43*b* is formed in a cylindrical shape including the shaft section 43*a* and the plurality of magnetic pole sections N1, S1, N2, N3, and S2. The sleeve 43*b* is rotatable by a not-illustrated driving source.

The developer moves on the developing roller 43 according to rotation of the sleeve 43*b*. The developer stands like the ears of rice with a magnetic force when passing on the magnetic pole sections N1, S1, N2, N3, and S2. If the developer stands like the ears of rice, the toner is separated from the developer and toner cloud occurs. The toner cloud is a cause of toner scattering.

The developer adheres to the developing roller 43 with a magnetic force of the grasping pole N3. The developer adhering to the developing roller 43 is conveyed to the development pole N1 through the second conveyance pole S2. The developing roller supplies the toner included in the developer to the photoconductive drum 14. A developer image (a toner image) is formed by the toner on the surface of the photoconductive drum 14. The developer is conveyed to the peeling pole N2 through the first conveyance pole S1 after the developer image is formed on the surface of the photoconductive drum 14. The developer adhering to the developing roller 43 is peeled from the developing roller 43 with repulsion of magnetic forces of the peeling pole N2 and the grasping pole N3.

The cover 70 is provided to close an upper opening of the developer storing section 60. The cover 70 includes a first cover 71 and a second cover 72.

The first cover 71 closes an upper opening of the first groove section 60*a*. The first cover 71 includes a wall section 73 connected to the upper end of the partition wall 61 and extending in the up-down direction. The wall section 73 is opposed to the developing roller 43 in the horizontal direction. A recessed section 73*a* recessed downward is formed on the upper end face of the wall section 73.

The second cover 72 is disposed above the second groove section 60*b* to close an upper opening of the second groove section 60*b*. The second cover 72 extends to above the developing roller 43 from the upper end portion of the wall section 73 of the first cover 71. The second cover 72 is opposed to the developing roller 43 in the up-down direction. The second cover 72 forms the opening section 45 between the second cover 72 and the developer storing section 60. The opening section 45 is formed on the opposite side of the wall section 73 of the first cover 71 across the developing roller 43. The developing roller 43 is opposed to the photoconductive drum 14 via the opening section 45.

Figure 5:
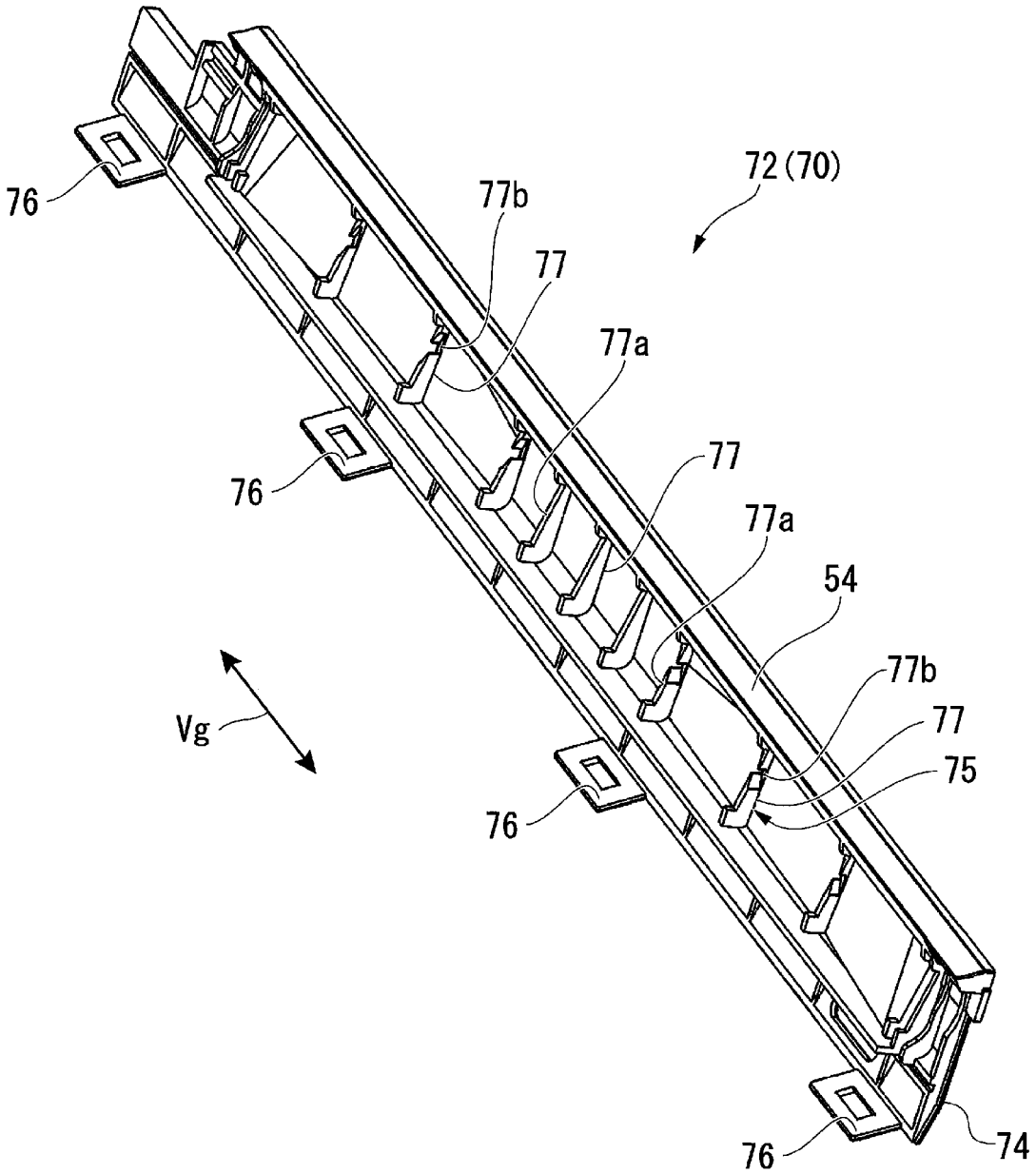
FIG. 5 is a perspective view illustrating a second cover in the embodiment.

FIG. 5 is a perspective view illustrating the second cover 72 in the embodiment.

As illustrated in FIG. 5, the second cover 72 includes a main body section 74, a holding section 75, and engaging sections 76. For example, the main body section 74, the holding section 75, and the engaging sections 76 are integrally formed by the same member. The main body section 74 is formed in a tabular shape extending in the roller axial direction Vg. The main body section 74 covers at least a part of the developing roller 43 (see FIG. 3) from above.

The holding section 75 extends toward the developing roller 43 from the main body section 74. The holding section 75 holds the gap forming member 51 between the main body section 74 and the developing roller 43 (see FIG. 3). The holding section 75 includes a plurality of ribs 77 disposed at intervals in the roller axial direction Vg. The plurality of ribs 77 linearly extend in a direction orthogonal to the roller axial direction Vg when viewed from the developing roller 43 side. Recessed sections 77*a*, which receive the gap forming member 51, are formed in the plurality of ribs 77. The recessed sections 77*a* are formed at end edges opposed to the developing roller 43 in the ribs 77. The plurality of recessed sections 77*a* are formed in the same shape in the same positions when viewed from the roller axial direction Vg. Cutouts 77*b* are formed in the ribs 77 on the outer sides in the roller axial direction Vg among the plurality of ribs 77. The cutouts 77*b* are opened in a direction parallel to the roller axial direction Vg. The cutouts 77*b* cause spaces adjacent to each other in the roller axial direction Vg across the ribs 77 to communicate.

As illustrated in FIG. 3, the engaging sections 76 extend to enter the recessed section 73*a* of the wall section 73 of the first cover 71 from the main body section 74. The second cover 72 is detachably attached to the first cover 71 by the engaging sections 76.

A doctor blade 46 and a shield section 47 are provided in the opening section 45 of the housing 40. The doctor blade 46 and the shield section 47 are provided in the developer storing section 60. The doctor blade 46 is provided on the upstream side in the roller rotating direction J1 in the opening section 45. The doctor blade 46 is disposed along the surface of the developing roller 43. The doctor blade 46 restricts a layer thickness of the developer carried on the developing roller 43. The shield section 47 blocks a flow of air from the developing device 13 to the photoconductive drum 14 (see FIG. 2). The shield section 47 is provided between the doctor blade 46 and the photoconductive drum 14. The shield section 47 extends from the developer storing section 60 to close a gap between the doctor blade 46 and the developing roller 43.

The gap forming member 51 is disposed between the developing roller 43 and the second cover 72. For example, the gap forming member 51 is formed of a resin material, a metal material, or the like. For example, the resin material forming the gap forming member 51 is hard resin or the like. The gap forming member 51 is formed in a flat shape extending in the roller axial direction Vg. The gap forming member 51 is disposed substantially in parallel to the main body section 74 of the second cover 72. The gap forming member 51 is disposed in the recessed sections 77*a* of the plurality of ribs 77 of the second cover 72. The gap forming member 51 is attached to the plurality of ribs 77 by bonding, engagement, fitting, or the like.

The gap forming member 51 includes a first surface 51*a* facing the developing roller 43 and a second surface 51*b* facing the housing 40. The gap forming member 51 forms a first gap G1 between the gap forming member 51 and the developing roller 43. The first surface 51*a* of the gap forming member 51 is a plane and is opposed to the developing roller 43 across the first gap G1. The gap forming member 51 forms a second gap G2 between the gap forming member 51 and the second cover 72. The second surface 51*b* of the gap forming member 51 is a plane and is opposed to the main body section 74 of the second cover 72 across the second gap G2.

The first gap G1 includes a first opening E1 and a second opening E2. The first opening E1 is an opening at the upstream side end portion in the roller rotating direction J1 in the first gap G1. The position of the first opening E1 is on a straight line extending to the closest position on the surface of the developing roller 43 from the end edge on the upstream side in the roller rotating direction J1 on the first surface 51*a* of the gap forming member 51 in a sectional view from the roller axial direction Vg. The second opening E2 is an opening at the downstream side end portion in the roller rotating direction J1 in the first gap G1. The position of the second opening E2 is on a straight line extending to the closest position on the surface of the developing roller 43 from the end edge on the downstream side in the roller rotating direction J1 on the first surface 51*a* of the gap forming member 51 in the sectional view from the roller axial direction Vg.

The second gap G2 includes a third opening E3 (a downstream side opening) and a fourth opening E4 (an upstream side opening). The third opening E3 is an opening at the downstream side end portion in the roller rotating direction J1 in the second gap G2. The position of the third opening E3 is on a straight line extending to the closest position on the inner surface of the housing 40 from the end edge on the downstream side in the roller rotating direction J1 on the second surface 51*b* of the gap forming member 51 in the sectional view from the roller axial direction Vg. The fourth opening E4 is an opening at the upstream side end portion in the roller rotating direction J1 in the second gap G2. The position of the fourth opening E4 is on a straight line extending to the closest position on the inner surface of the housing 40 from the end edge on the upstream side in the roller rotating direction J1 on the second surface 51*b* of the gap forming member 51 in the sectional view from the roller axial direction Vg. In the third opening E3 and the fourth opening E4, an interval between the housing 40 and the gap forming member 51 is 0.5 mm or more. In the entire second gap G2, the interval between the housing 40 and the gap forming member 51 is desirably 0.5 mm or more and 5.0 mm or less and more desirably 1.0 mm or more.

Figure 6:
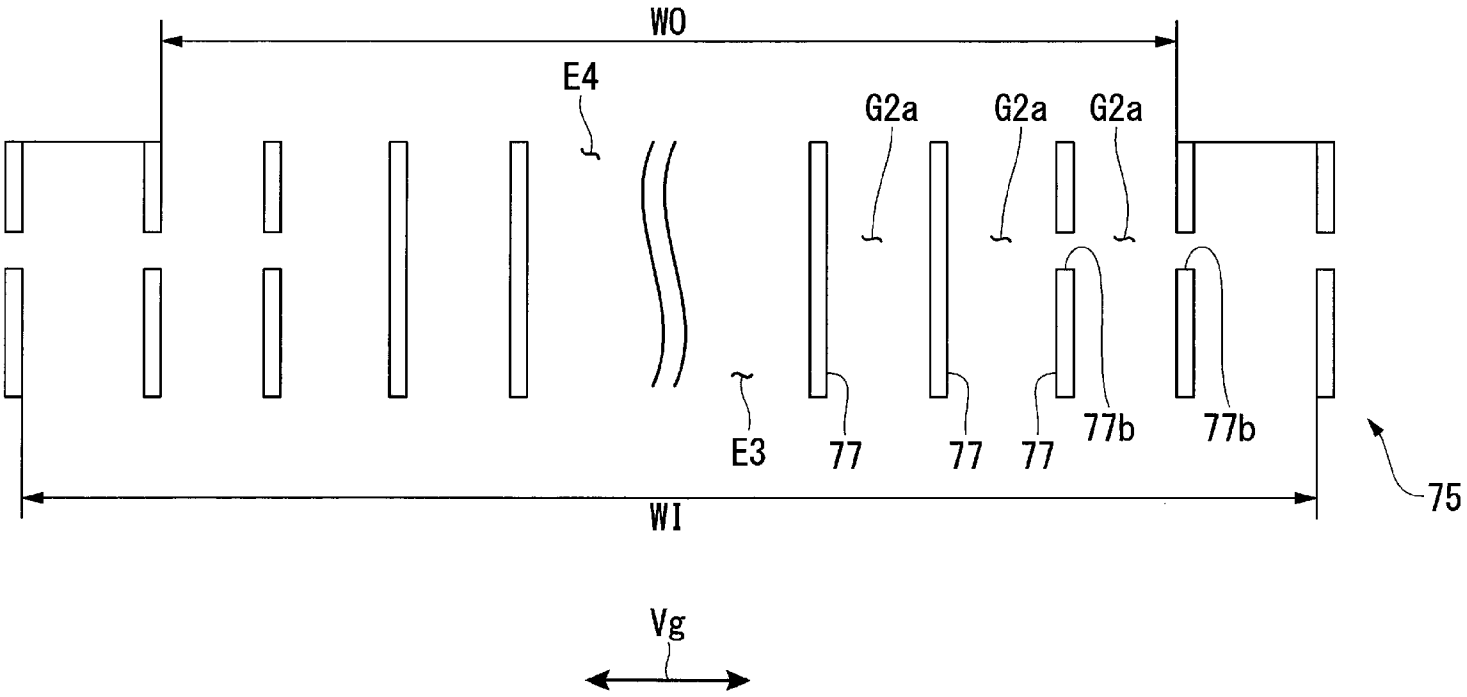
FIG. 6 is a plan view illustrating an example of a holding section in the embodiment.

FIG. 6 is a plan view illustrating an example of the holding section 75 in the embodiment.

As illustrated in FIG. 6, the second gap G2 is divided into a plurality of spaces G2*a* by the plurality of ribs 77. The third opening E3 and the fourth opening E4 are continuous in the roller axial direction Vg. The third opening E3 is provided in all spaces G2*a*. The fourth opening E4 is provided in the space G2*a* in the center in the roller axial direction Vg among the plurality of spaces G2*a*. A dimension WI of the third opening E3 in the roller axial direction Vg is the same as the length of the developing roller 43 in the roller axial direction Vg. For example, the dimension WI of the third opening E3 is approximately 310 mm. In the roller axial direction Vg, the dimension WI of the third opening E3 is larger than a dimension WO of the fourth opening E4 (WI>WO). For example, a ratio WO/WI of the dimension WO of the fourth opening E4 and the dimension WI of the third opening E3 is 0.5 or more and 0.8 or less.

Figure 7:
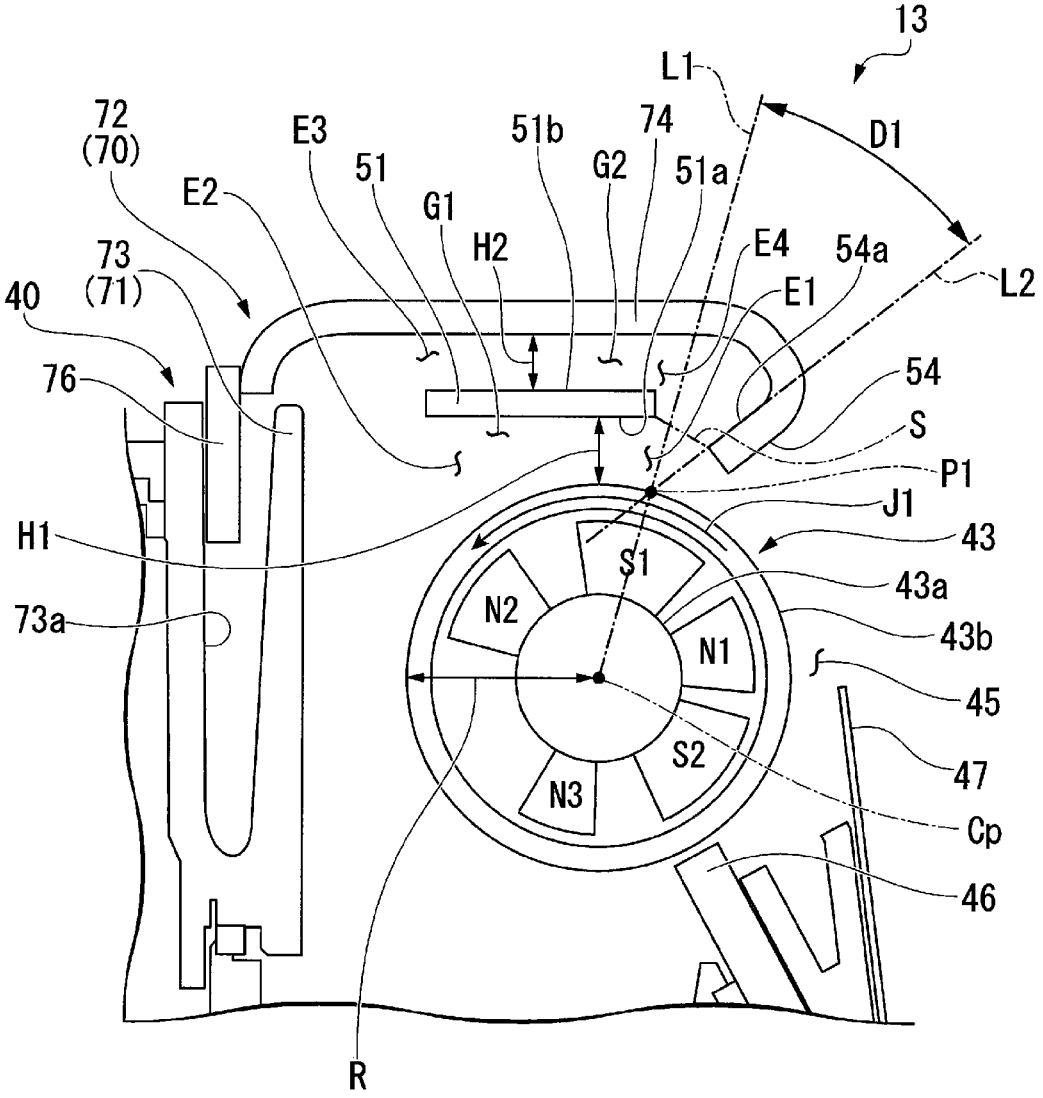
FIG. 7 is a main part enlarged view of FIG. 3.

FIG. 7 is a main part enlarged view of FIG. 3. In FIG. 7, the rib 77 indicated by the imaginary line in FIG. 3 is omitted.

As illustrated in FIG. 7, an interval between the developing roller 43 and the gap forming member 51 in the first gap G1 is the smallest in one part between the first opening E1 and the second opening E2 when viewed from the roller axial direction Vg. An interval between the housing 40 and the gap forming member 51 in the second gap G2 is substantially fixed when viewed from the roller axial direction Vg. A relation of H1/H2<5 is satisfied, where H1 is a minimum interval between the developing roller 43 and the gap forming member 51 in the first gap G1 and H2 is a minimum interval between the housing 40 and the gap forming member 51 in the second gap G2. A relation of H1/R<⅔ is satisfied, where R is the radius of the developing roller 43. For example, if the radius of the developing roller 43 is 9 mm, the minimum interval H1 is desirably 6 mm or less.

The guide section 54 directs an air current discharged from the second gap G2 via the fourth opening E4 to the first gap G1. The guide section 54 is provided on the downstream side in the roller rotating direction J1 in the opening section 45 of the housing 40. The guide section 54 is provided further on the upstream side in the roller rotating direction J1 than the gap forming member 51. The guide section 54 is provided to cover the fourth opening E4 from the radial direction outer side of the developing roller 43 and the upstream side in the roller rotating direction J1. The guide section 54 extends from an end portion on the upstream side in the roller rotating direction J1 in the main body 74 of the second cover 72 of the housing 40 toward the developing roller 43. In this embodiment, the guide section 54 is integrally formed by the same member as the main body section 74 of the second cover 72. The distal end of the guide section 54 is separated from the developing roller 43. The guide section 54 includes a guide surface 54*a* facing the fourth opening E4 of the second gap G2. The guide surface 54*a* is the inner surface of the guide section 54 that is in contact with the air current guided by the guide section 54. A perpendicular of an imaginary line segment S extending at a shortest distance from the distal end of the guide surface 54*a* to the gap forming member 51 crosses at least one of the surface of the developing roller 43 and the first gap G1 in the sectional view from the roller axial direction Vg.

A first imaginary straight line L1, which is a reference line, and a second imaginary straight line L2 passing the guide surface 54*a* are set in the sectional view from the roller axial direction Vg. The second imaginary straight line L2 is a tangential line at the end portion on the developing roller 43 side of the guide surface 54*a*. The first imaginary straight line L1 is an imaginary straight line passing an intersection P1 of the second imaginary straight line L2 and the surface of the developing roller 43 and a rotation center Cp of the developing roller 43. In the following explanation, an angle D1 formed by the first imaginary straight line L1 and the second imaginary straight line L2 when viewed from the roller axial direction Vg is referred to as "angle D1 of the guide surface".

The second imaginary straight line L2 extends further to the first gap G1 side than the rotation center Cp of the developing roller 43 from the guide surface 54*a*. The angle D1 of the guide surface 54*a* is desirably plus 30 degrees or more and 90 degrees or less. The angle D1 of the guide surface 54*a* is more desirably plus 45 degrees or more.

A flow of air around the developing device is explained.

Figure 8:
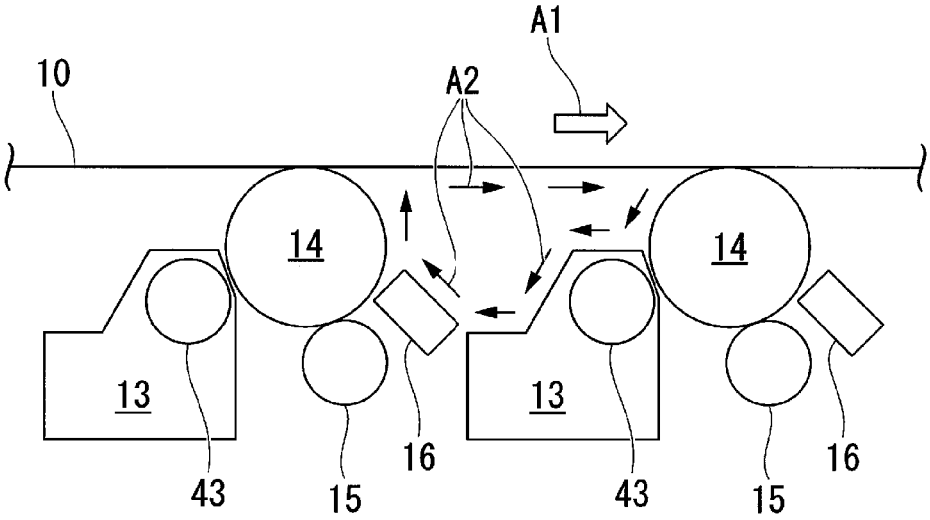
FIG. 8 is a side view for explaining a flow of air around the developing device.
Figure 9:
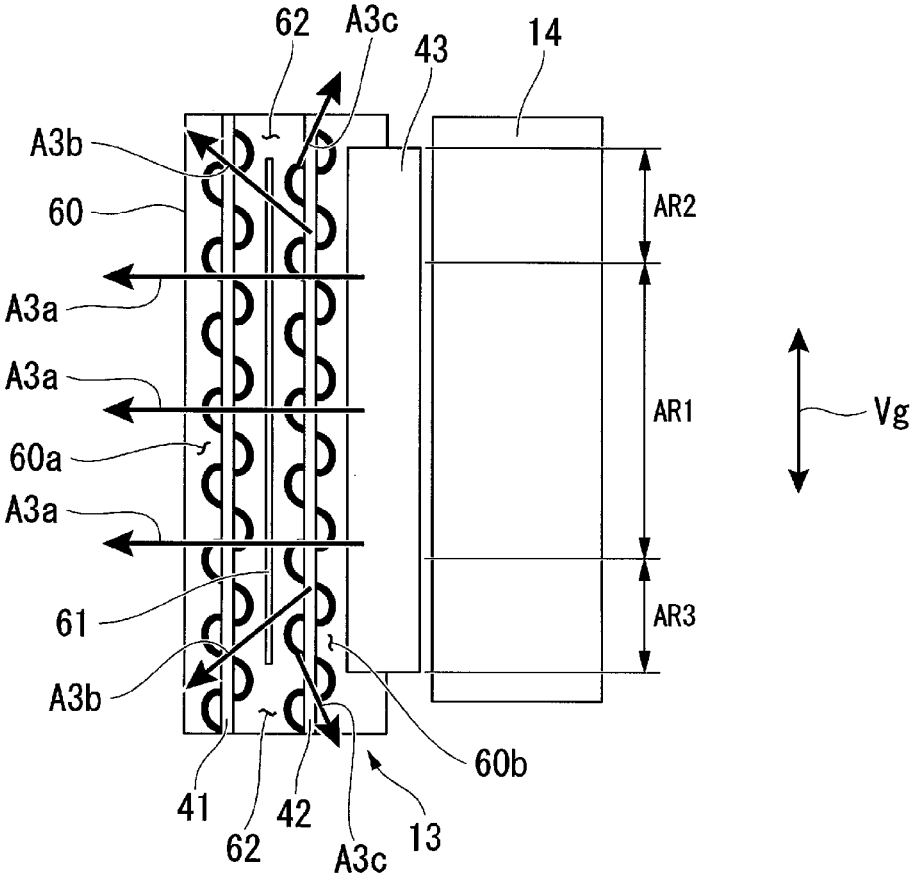
FIG. 9 is a plan view for explaining the flow of the air around the developing device.

FIG. 8 is a side view for explaining a flow of air around the developing device 13 according to the embodiment. FIG. 9 is a plan view for explaining the flow of the air around the developing device 13 according to the embodiment.

As illustrated in FIG. 8, air around one developing device 13 (the developing device 13 on the left side) flows in an arrow A2 direction in a space between another developing device 13 (the developing device 13 on the right side), which is adjacent on the downstream side in a rotating direction (an arrow A1 direction) of the intermediate transfer body 10, and the intermediate transfer body 10.

As illustrated in FIG. 9, in a space between the developing device 13 and the intermediate transfer body 10 (see FIG. 8), an area AR1 in the center in the roller axial direction Vg and areas AR2 and AR3 at end portions in the roller axial direction Vg are set. In the following explanation, the area AR1 in the center in the roller axial direction Vg is referred to as "center area AR1" and the areas AR2 and AR3 at the end portions in the roller axial direction Vg are referred to as "end portion areas AR2 and AR3".

For example, in the roller axial direction Vg, the dimension of the end portion areas AR2 and AR3 is 15% or more and 20% or less of the dimension of the intermediate transfer body 10. For example, in the roller axial direction Vg, if the dimension of the intermediate transfer body 10 is 330 mm and the dimension of the developing roller 43 is 310 mm, the dimension of the end portion areas AR2 and AR3 is equivalent to 30 mm or more and 45 mm or less from the end portions of the developing roller 43.

In the space between the developing device 13 and the intermediate transfer body 10 (see FIG. 8), flows of air in the center area AR1 and the end portion areas AR2 and AR3 are different. In the center area AR1, the air around the developing device 13 flows in an arrow A3*a* direction in the space between the developing device 13 and the intermediate transfer body 10.

As illustrated in FIG. 8, in the center area AR1 (see FIG. 9), the air around the developing device 13 flows in the same direction as the rotating direction of the intermediate transfer body 10 (the arrow A1 direction) in the vicinity of the intermediate transfer body 10. On the other hand, in the center area AR1, the air around the developing device 13 flows in the opposite direction of the rotating direction of the intermediate transfer body 10 (the arrow A1 direction) in the vicinity of the developing device 13. That is, in the center area AR1, the air around the developing device 13 circulates in the arrow A2 direction in the space between the developing device 13 and the intermediate transfer body 10. Even if the air including toner leaks to the outside of the developing device 13 in the center area AR1, since the toner is easily carried by the intermediate transfer body 10, the functional components such as the charger 15 are less likely to be stained.

As illustrated in FIG. 9, in the end portion areas AR2 and AR3, there is a flow of air added with a component in a direction orthogonal to the rotating direction of the intermediate transfer body 10 (see FIG. 8) (the arrow A1 direction) (in a direction parallel to the roller axial direction Vg). In the end portion areas AR2 and AR3, the air around the developing device 13 flows in an arrow A3*b* direction or an arrow A3*c* direction in the space between the developing device 13 and the intermediate transfer body 10. If the air including the toner leaks to the outside of the developing device 13 in the end portion areas AR2 and AR3, since the toner is less easily carried by the intermediate transfer body 10, the functional components such as the charger 15 are highly likely to be stained.

A flow of air in the developing device 13 is explained.

Figure 10:
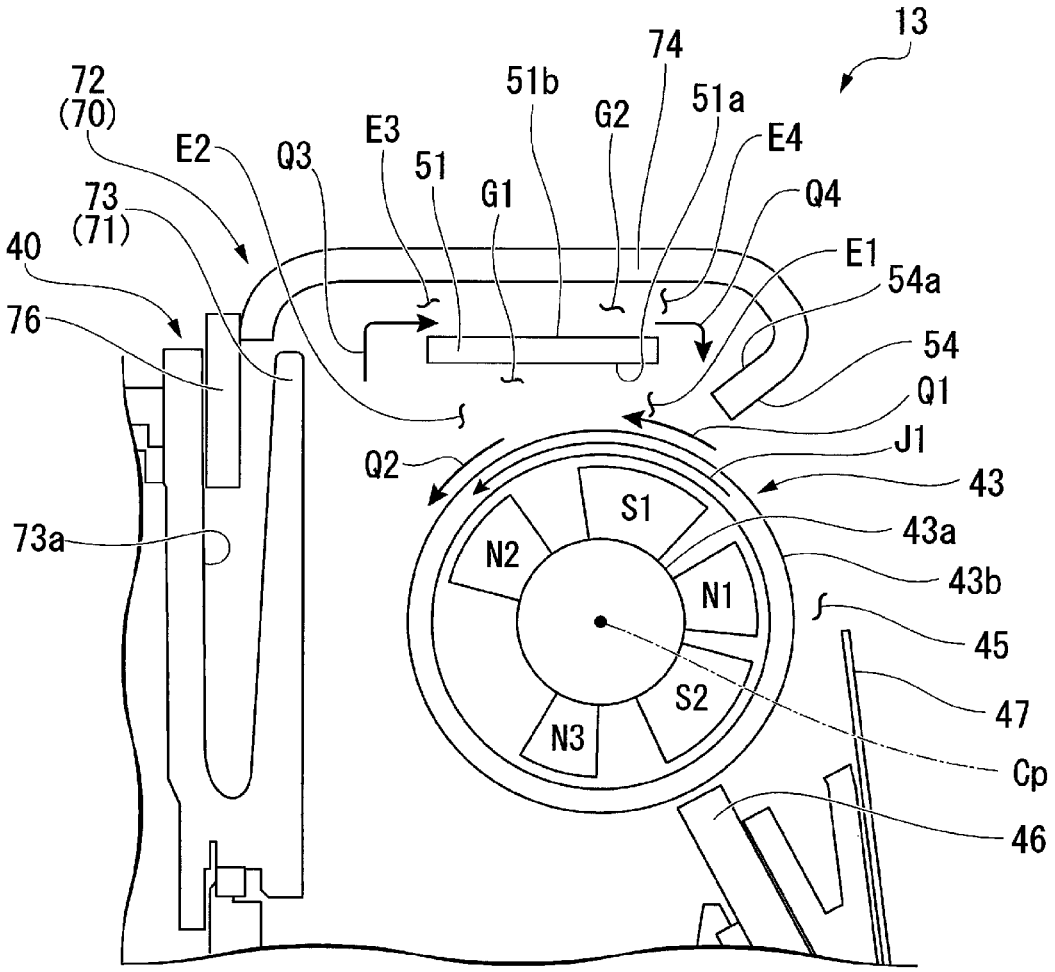
FIG. 10 is a sectional view for explaining a flow of air in the developing device.

FIG. 10 is a sectional view for explaining a flow of air in the developing device 13 according to the embodiment. FIG. 10 is a diagram equivalent to FIG. 7.

As illustrated in FIG. 10, the developing roller 43 rotates in the arrow J1 direction, whereby the developer carried on the surface of the developing roller 43 engulfs air into the housing 40. Then, a flow of wind in arrow Q1 and Q2 directions occurs in the first gap G1 and the air flows into the housing 40. If the air flows into the housing 40, pressure in the housing 40 rises.

As explained above, H1/H2<5 is satisfied concerning the minimum interval H1 of the first gap G1 and the minimum interval H2 of the second gap G2 (see FIG. 7). Therefore, a channel sectional area of the second gap G2 is not sufficiently smaller than a channel sectional area of the first gap G1. Consequently, a channel resistance in the second gap G2 is not sufficiently smaller than a channel resistance in the first gap G1. Accordingly, if the pressure in the housing 40 rises, the air in the housing 40 is about to flow toward the outside of the housing 40 through the second gap G2 without flowing back in the first gap G1. That is, if the pressure in the housing 40 rises, a flow of air in an arrow Q3 direction from the second opening E2 of the first gap G1 toward the fourth opening E4 through the third opening E3 of the second gap G2 occurs.

The flow of the air in the arrow Q3 direction is discharged in an arrow Q4 direction from the fourth opening E4 of the second gap G2 while engulfing the toner in the housing 40. At this time, the air including the toner is directed to the first gap G1 by the guide section 54. Therefore, most of the air including the toner flows into the first gap G1 again.

The air including the toner flowing into the first gap G1 flows in the order of the arrow Q1 direction, the arrow Q2 direction, the arrow Q3 direction, and the arrow Q4 direction in the housing 40. That is, a circulation path of the flow of the air including the toner is formed in the housing 40 by the first gap G1 and the second gap G2.

As explained above, the developing device 13 according to this embodiment includes the housing 40, the developing roller 43, the gap forming member 51, and the guide section 54. The gap forming member 51 is provided on the downstream side in the roller rotating direction J1 with respect to the development pole N1 of the developing roller 43. The gap forming member 51 forms the first gap G1 between the gap forming member 51 and the developing roller 43 and forms the second gap G2 between the gap forming member 51 and the housing 40. The guide section 54 directs the air current discharged from the second gap G2 via the fourth opening E4 of the second gap G2 to the first gap G1. The relation of H1/H2<5 is satisfied, where H1 is the minimum interval between the developing roller 43 and the gap forming member 51 in the first gap G1 and H2 is the minimum interval between the housing 40 and the gap forming member 51 in the second gap G2 when viewed from the roller axial direction Vg.

With this configuration, concerning a flow of air around the gap forming member 51, it is possible to prevent the channel resistance in the second gap G2 from becoming sufficiently smaller than the channel resistance in the first gap G1. Therefore, if the developer carried on the surface of the developing roller 43 engulfs the air into the housing 40 and the pressure in the housing 40 rises, the air in the housing 40 flows toward the second gap G2. The air flowing to the second gap G2 is discharged from the fourth opening E4 and flows toward the first gap G1 while being guided by the guide 54. Consequently, a circulation path of the flow of the air including the toner is formed around the gap forming member 51 in the housing 40. Accordingly, it is possible to prevent the air including the toner from blowing out to the outside of the developing device 13. Therefore, it is possible to prevent the toner from scattering to the outside of the developing device 13. It is possible to provide the image forming apparatus 1 in which occurrence of an image defect due to contamination of the functional components such as the charger 15 is suppressed.

Further, there has been a configuration in which a filter, a fan, and the like for collecting scattering toner are provided in order to reduce scattering of the toner to the outside of a developing device. However, it is likely that the filter for capturing the toner is clogged before exhausting product life. A fan and a duct also need to be provided if the filter is provided. An apparatus is likely to increase in size. According to this embodiment, it is unnecessary to provide a filter. This improves maintainability and is suitable in avoiding an increase in the size of the apparatus.

A relation of H1/R<⅔ is satisfied, where R is the radius of the developing roller 43. With this configuration, it is possible to prevent the interval between the developing roller 43 and the gap forming member 51 from becoming excessively large with respect to a curvature radius of the surface of the developing roller 43. Therefore, if the developer carried on the surface of the developing roller 43 engulfs the air into the housing 40 in the first gap G1, air near the surface of the gap forming member 51 can also be engulfed into the housing 40. Accordingly, it is possible to surely form a circulation path of the flow of the air including the toner around the gap forming member 51 in the housing 40. Therefore, it is possible to suppress scattering of the toner to the outside of the developing device 13.

The dimension WO of the fourth opening E4 of the second gap G2 in the roller axial direction Vg is smaller than the dimension WI of the third opening E3 in the roller axial direction Vg. With this configuration, compared with when the dimension WO of the fourth opening E4 is equal to or larger than the dimension WI of the third opening E3 (WI≤WO), the flow of the air including the toner easily concentrates in the center area AR1. That is, it is possible to prevent the air including the toner from flowing to the end portion areas AR2 and AR3. If the air including the toner leaks to the outside of the developing device 13 in the center area AR1, since the toner is easily carried by the intermediate transfer body 10, the functional components such as the charger 15 are less likely to be stained. Therefore, it is possible to suppress contamination of the functional component such as the charger 15.

Further, the dimensions WO and WI satisfy a relation of 0.5≤WO/WI≤0.8. If WO/WI is smaller than 0.5, the air including the toner is more likely to flow to the end portion areas AR2 and AR3. This is estimated to be because, if WO/WI is smaller than 0.5, the dimension WO of the fourth opening E4 is too small, discharge of the air in the developing device 13 is insufficient, and the pressure in the developing device 13 excessively rises. On the other hand, if WO/WI exceeds 0.8, the dimension WO of the fourth opening E4 is too large. It is difficult to concentrate the flow of the air including the toner in the center area AR1. According to this embodiment, WO/WI is 0.5 or more and 0.8 or less. Therefore, the flow of the air including the toner concentrates in a center area AR1. This is suitable in suppressing contamination of the functional components such as the charger 15.

The guide section 54 extends from the main body section 74 of the second cover 72 of the housing 40 toward the developing roller 43. With this configuration, if the guide section 54 is integrally formed by the same member as the second cover 72, it is unnecessary to separately provide a guide member. Therefore, it is possible to reduce the number of components and simplify an apparatus configuration.

The guide section 54 includes the guide surface 54*a* with which an air current discharged from the second gap G2 comes into contact. A tangential line at the end portion on the developing roller 43 side of the guide surface 54*a* viewed from the roller axial direction Vg extends further toward the first gap G1 than the rotation center Cp of the developing roller 43 from the guide surface 54*a*. With this configuration, it is possible to surely guide the air discharged from the second gap G2 toward the first gap G1. This is suitable in suppressing scattering of the toner to the outside of the developing device 13.

The second gap G2 is divided into the plurality of spaces G2*a* by the plurality of ribs 77. Therefore, it is possible to smoothly feed the air including the toner in the plurality of spaces G2*a*. If the air including the toner smoothly flows in the plurality of spaces G2*a*, a circulation path of the flow of the air including the toner is easily formed in the housing 40. Therefore, it is possible to more efficiently prevent the air including the toner from blowing out to the outside of the developing device 13.

The inventor confirmed a relation between the minimum interval H1 between the developing roller 43 and the gap forming member 51 in the first gap G1 and the minimum interval H2 between the housing 40 and the gap forming member 51 in the second gap G2 and a failure-causing number of printed sheets. The failure-causing number of printed sheets is the number of sheets printed until contamination of the toner worsens in the functional components such as the charger and an image defect occurs. The radius of the developing roller 43 was set to 9 mm. The angle D1 of the guide surface 54*a* was set to 60 degrees. The dimension WO of the fourth opening E4 was set to 200 mm.

Figure 11:
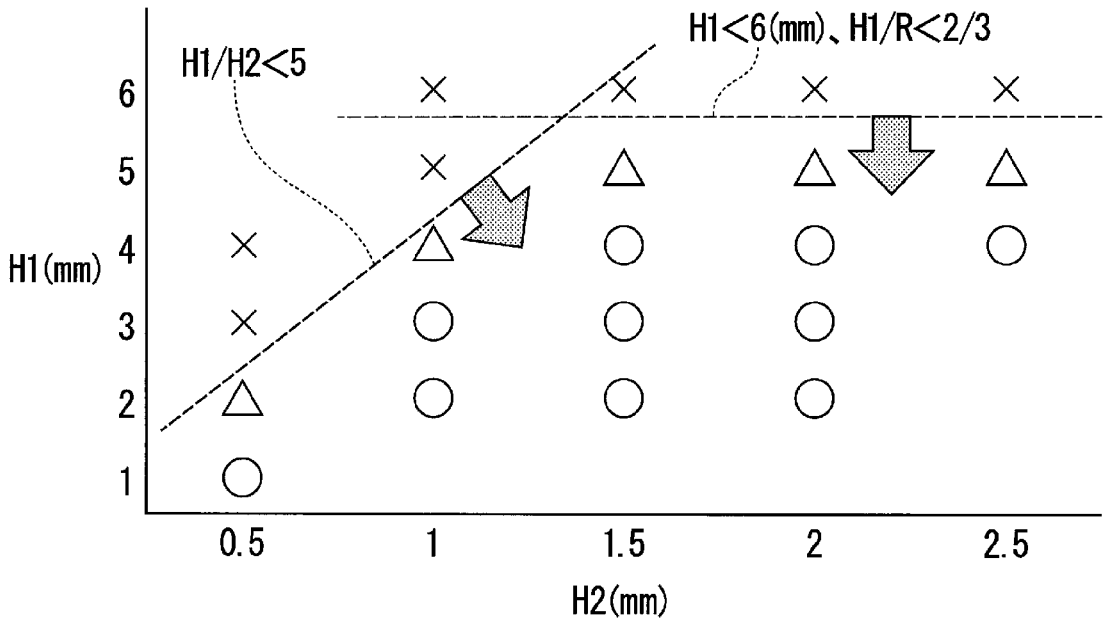
FIG. 11 is a diagram illustrating a relation between minimum intervals H1 and H2 and a failure-causing number of printed sheets.

FIG. 11 is a diagram illustrating the relation between the minimum intervals H1 and H2 and the failure-causing number of printed sheet. The failure-causing number of printed sheets smaller than 80,000 is represented by "A", the failure-causing number of printed sheets equal to or larger than 80,000 and smaller than 160,000 is represented as "B", and the failure-causing number of printed sheets larger than 160,000 is represented by "C".

As illustrated in FIG. 11, it was confirmed that the failure-causing number of printed sheets was 80,000 or more by setting H1 and H2 to satisfy H1/H2<5. It was confirmed that the failure-causing number of printed sheets was 80,000 or more by setting H1 and R to satisfy H1/R<2.

Modifications are explained below. Components other than components explained below are the same as the components in the embodiment.

The holding section 75 is not limited to include the plurality of ribs 77 linearly extending in the direction orthogonal to the roller axial direction Vg when viewed from the side of the gap forming member 51. For example, the holding section 75 may include a plurality of ribs linearly extending in a direction crossing the roller axial direction Vg when viewed from the side of the gap forming member 51.

Figure 12:
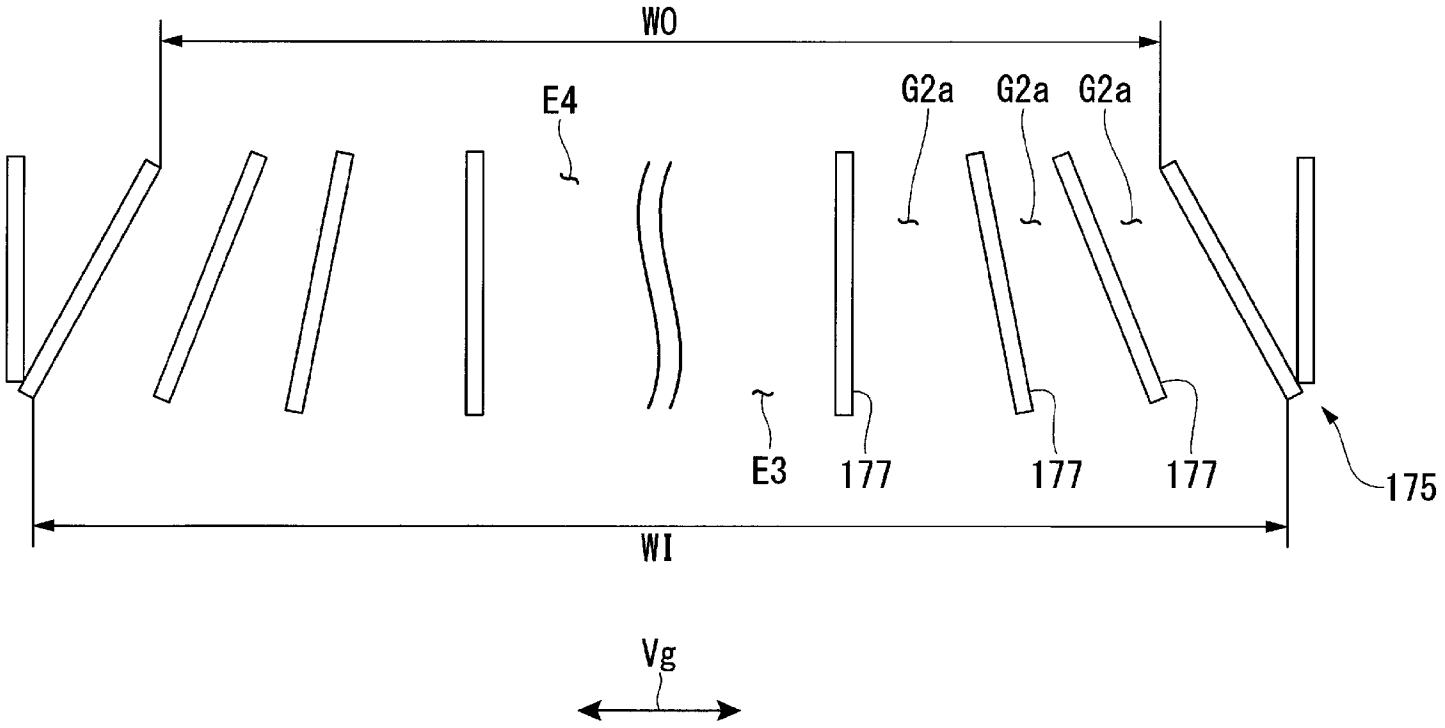
FIG. 12 is a plan view illustrating a modification of the holding section.

FIG. 12 a plan view illustrating a modification of the holding section in the embodiment. FIG. 12 is a diagram equivalent to FIG. 6 in which a holding section 175 is viewed from the side of the gap forming member 51 (see FIG. 3).

As illustrated in FIG. 12, the holding section 175 includes a plurality of ribs 177. The plurality of ribs 177 linearly extend in the direction crossing the roller axial direction Vg to be located closer to the center in the roller axial direction Vg toward the side of the fourth opening E4 when viewed from the side of the gap forming member 51 (see FIG. 3). The plurality of spaces G2*a*, which cause the third opening E3 and the fourth opening E4 to communicate, are formed by the plurality of ribs 177. The plurality of ribs 177 divide the second gap G2 (see FIG. 3) to form the plurality of spaces G2*a*. An interval of two ribs 177 adjacent to each other in the roller axial direction Vg is smaller toward the side of the fourth opening E4.

According to this modification, since the second gap G2 is divided into the plurality of spaces G2*a* by the plurality of ribs 177, it is possible to smoothly feed the air including the toner in the plurality of spaces G2*a*. If the air including the toner smoothly flows in the plurality of spaces G2*a*, a circulation path of the flow of the air including the toner is easily formed in the housing 40. Therefore, it is possible to more effectively prevent the air including the toner from blowing out to the outside of the developing device 13.

The guide section 54 is not limited to be integrally formed by the same member as the main body section 74 of the second cover 72 of the housing 40. For example, at least a part of the guide section 54 may be formed separately from the main body section 74 of the second cover 72.

Figure 13:
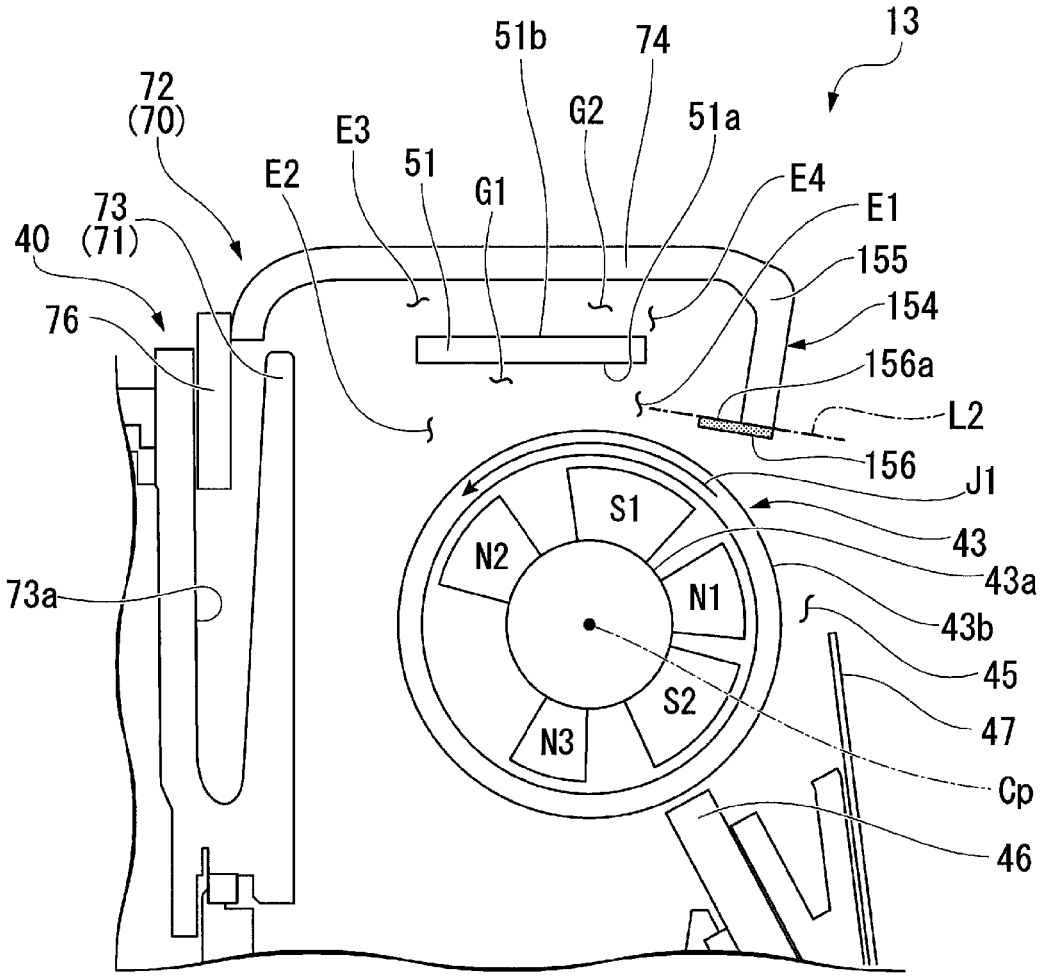
FIG. 13 is a sectional view illustrating a first modification of a guide section in the embodiment.

FIG. 13 is a sectional view illustrating a first modification of the guide section in the embodiment. In FIG. 13, a cross section hatching is omitted. In FIG. 13, as in FIG. 7, illustration of the rib 77 is omitted.

As illustrated in FIG. 13, the guide section 154 includes an extending section 155 and a guide plate 156. The extending section 155 extends toward the developing roller 43 from the end portion on the upstream side in the roller rotating direction J1 in the main body section 74 of the second cover 72 of the housing 40. For example, the extending section 155 is integrally formed by the same member as the main body section 74 of the second cover 72. The distal end of the extending section 155 is separated from the developing roller 43.

The guide plate 156 is formed separately from the main body section 74 of the second cover 72. The guide plate 156 is attached to the distal end of the extending section 155. The guide plate 156 is formed in a tabular shape extending toward the first gap G1 from the distal end of the extending section 155. For example, the guide plate 156 is a sheet material such as polyethylene terephthalate (PET).

The guide plate 156 directs air discharged from the second gap G2 via the fourth opening E4 to the first gap G1. The guide plate 156 includes a guide surface 156*a* facing the fourth opening E4 of the second gap G2. The guide surface 156*a* is the inner surface of the guide plate 156 that is in contact with an air current guided by the guide plate 156. The guide plate 156 is separated from the developing roller 43. If the second imaginary straight line L2 is defined as in the embodiment, the second imaginary straight line L2 extends further to the first gap G1 side than the rotation center Cp of the developing roller 43 from the guide surface 156*a*. An angle (not illustrated in FIG. 13) of the guide surface 156*a* is desirably plus 30 degrees or more. In the example illustrated in FIG. 13, the angle of the guide surface 156*a* is 90 degrees.

An interval between the gap forming member 51 and the guide plate 156 is desirably 0.5 mm or more in a direction in which the guide plate 156 projects from the extending section 155. Consequently, it is possible to prevent a flow of the air flowing from the fourth opening E4 of the second gap G2 toward the first gap G1 from being deteriorated. Therefore, the air discharged from the fourth opening E4 can be smoothly guided toward the first gap G1 by the guide section 154. Therefore, it is possible to suppress scattering of the toner to the outside of the developing device 13.

The guide section 154 includes the extending section 155 and the guide plate 156. The extending section 155 extends toward the developing roller 43 from the main body section 74 of the second cover 72 of the housing 40. The guide plate 156 extends toward the first gap G1 from the distal end of the extending section 155. Consequently, if the extending section 155 is integrally formed by the same member as the main body 74 of the second cover 72, it is unnecessary to separately provide an extending member. Therefore, it is possible to reduce the number of components and simplify the apparatus configuration. In addition, if the guide plate 156 is formed separately from the main body section 74 of the second cover 72, the direction of the guide plate 156 is easily adjusted to be proper.

Figure 14:
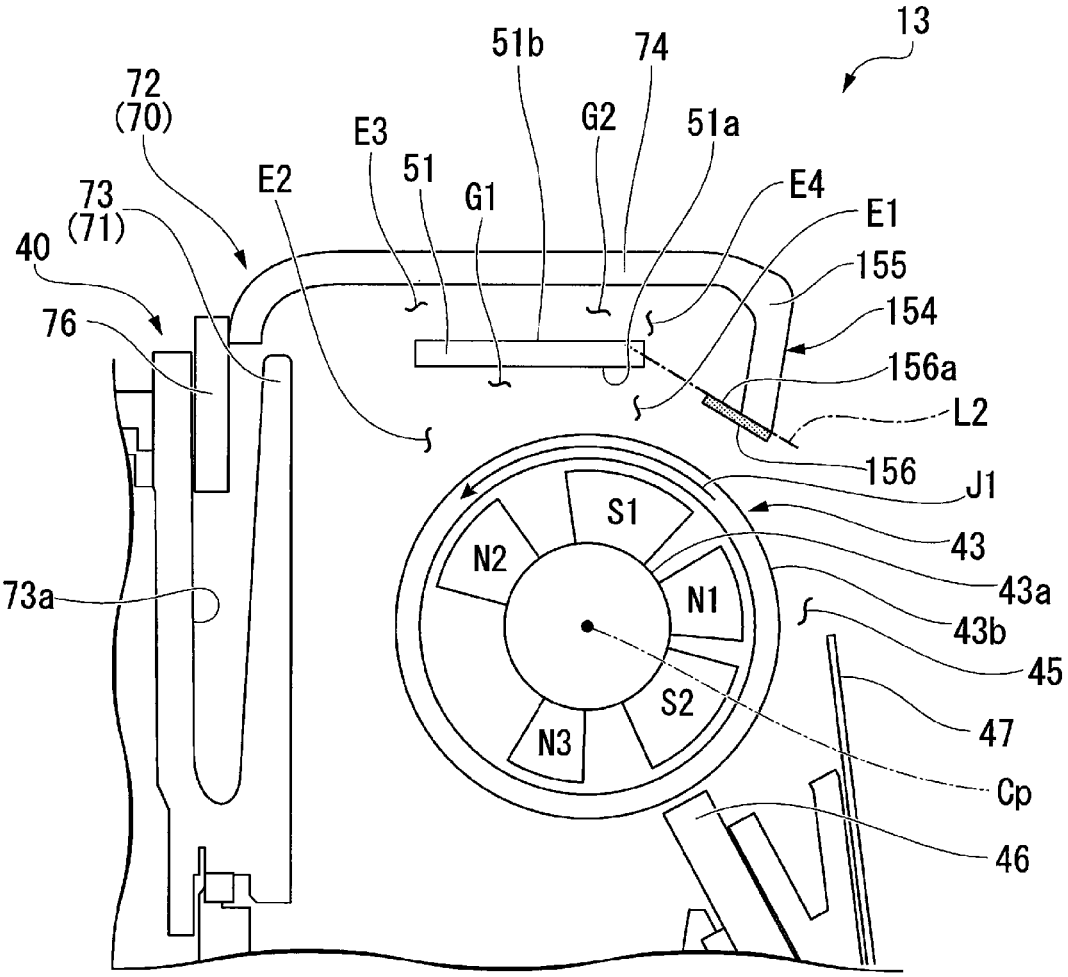
FIG. 14 is a sectional view illustrating a second modification of the guide section.

FIG. 14 is a sectional view illustrating a second modification of the guide section in the embodiment. In FIG. 14, a cross section hatching is omitted. In FIG. 14, as in FIG. 7, illustration of the rib 77 is omitted.

As illustrated in FIG. 14, the guide plate 156 may extend further to the radial direction outer side of the developing roller 43 than the first gap G1 from the distal end of the extending section 155. Even with this configuration, it is possible to achieve the same action and effects as those of the guide section 154 explained above.

The gap forming member 51 is not limited to be formed in a flat shape. That is, the first surface 51*a* and the second surface 51*b* of the gap forming member 51 are not respectively limited to be single planes. At least one of the first surface and the second surface of the gap forming member may be a curved surface or may be a surface obtained by combining a plurality of at least one of planes and curved surfaces.

Figure 15:
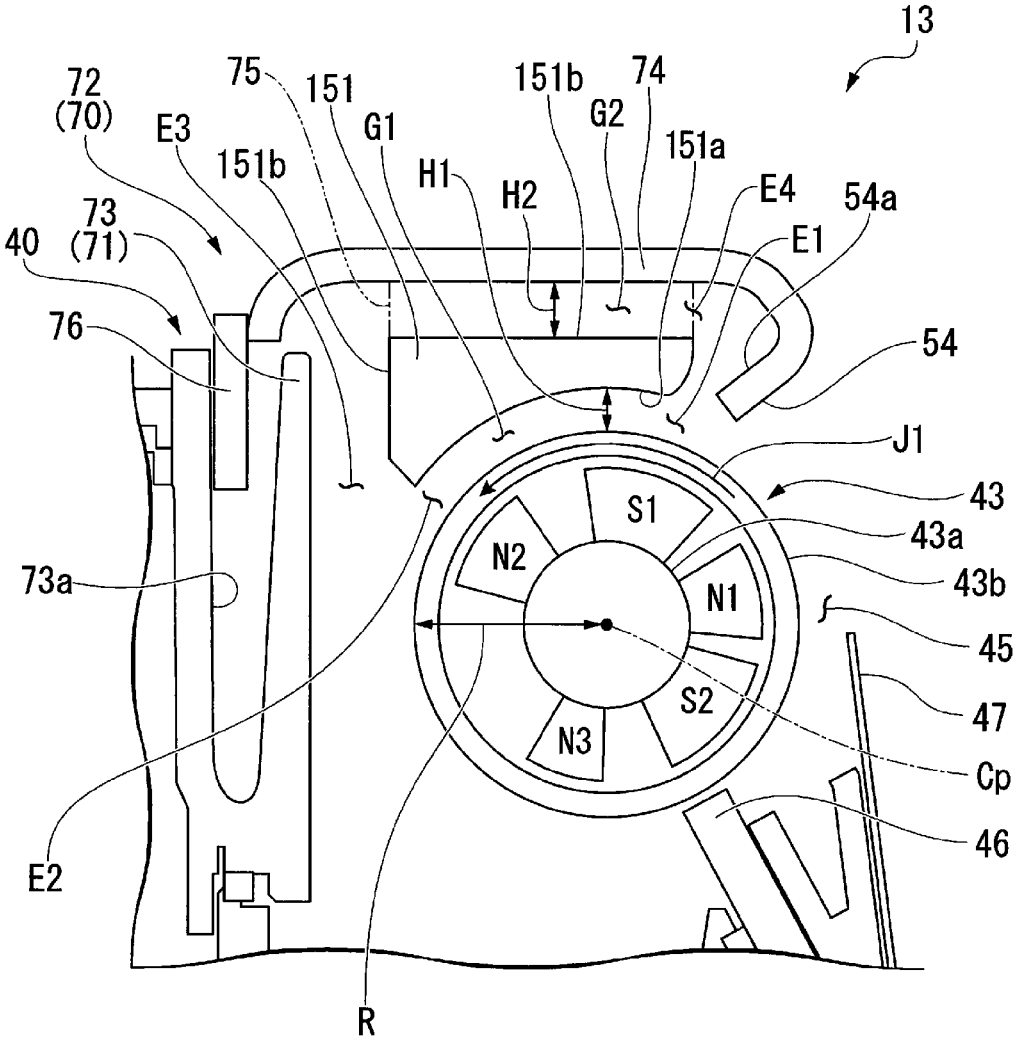
FIG. 15 is a sectional view illustrating a modification of a gap forming member in the embodiment.

FIG. 15 is a sectional view illustrating a modification of the gap forming member in the embodiment. In FIG. 15, a cross section hatching is omitted.

As illustrated in FIG. 15, a gap forming member 151 includes a first surface 151*a* facing the developing roller 43 and a second surface 151*b* facing the housing 40. The first surface 151*a* of the gap forming member 151 is a curved surface parallel to the surface of the developing roller 43. The first surface 151*a* of the gap forming member 151 is opposed to the developing roller 43 across the first gap G1. The second surface 151*b* of the gap forming member 151 is configured by a plane facing the wall section 73 of the first cover 71 of the housing 40 and a plane opposed to the main body section 74 of the second cover 72. The second surface 151*b* of the gap forming member 151 is opposed to the housing 40 across the second gap G2.

The first gap G1 includes the first opening E1 and the second opening E2. The first opening E1 is an opening at the upstream side end portion in the roller rotating direction J1 in the first gap G1. The position of the first opening E1 is on a straight line extending to the closest position on the surface of the developing roller 43 from the end edge on the upstream side in the roller rotating direction J1 on the first surface 151*a* of the gap forming member 151 in a sectional view from the roller axial direction Vg. The second opening E2 is an opening at the downstream side end portion in the roller rotating direction J1 in the first gap G1. The position of the second opening E2 is on a straight line extending to the closest position on the surface of the developing roller 43 from the end edge on the downstream side in the roller rotating direction J1 on the first surface 151*a* of the gap forming member 151 in the sectional view from the roller axial direction Vg.

The second gap G2 includes the third opening E3 (the downstream side opening) and the fourth opening E4 (the upstream side opening). The third opening E3 is an opening at the downstream side end portion in the roller rotating direction J1 in the second gap G2. The position of the third opening E3 is on a straight line extending to the closest position on the inner surface of the housing 40 from the end edge on the downstream side in the roller rotating direction J1 on the second surface 151*b* of the gap forming member 151 in the sectional view from the roller axial direction Vg. The fourth opening E4 is an opening at the upstream side end portion in the roller rotating direction J1 in the second gap G2. The position of the fourth opening E4 is on a straight line extending to the closest position on the inner surface of the housing 40 from the end edge on the upstream side in the roller rotating direction J1 on the second surface 151*b* of the gap forming member 151 in the sectional view from the roller axial direction Vg.

An interval between the developing roller 43 and the gap forming member 151 in the first gap G1 is substantially fixed when viewed from the roller axial direction Vg. An interval between the housing 40 and the gap forming member 151 in the second gap G2 is the smallest between the main body section 74 of the second cover 72 and the gap forming member 151 when viewed from the roller axial direction Vg. A relation of H1/H2<5 is satisfied, where H1 is a minimum interval between the developing roller 43 and the gap forming member 151 in the first gap G1 and H2 is a minimum interval between the housing 40 and the gap forming member 151 in the second gap G2. A relation of H1/R<⅔ is satisfied, where R is the radius of the developing roller 43.

With the gap forming member 151 in this modification, as in the gap forming member 51 in the embodiment, a circulation path of the flow of the air including the toner is formed in the housing 40 by the first gap G1 and the second gap G2. Therefore, it is possible to achieve the same action and effects as those in the embodiment explained above.

According to the at least one embodiment explained above, the relation of H1/H2<5 is satisfied, where H1 is a minimum interval between the developing roller and the gap forming member in the first gap and H2 is a minimum interval between the housing and the gap forming member in the second gap when viewed from the roller axial direction. Consequently, a circulation path of the flow of the air including the toner is formed around the gap forming member in the housing. Accordingly, it is possible to prevent the air including the toner from blowing out to the outside of the developing device. Therefore, it is possible to suppress scattering of the toner to the outside of the developing device.

The several embodiments are explained above. However, the embodiments are presented as examples and are not intended to limit the scope of the invention. These new embodiments can be implemented in other various forms. Various omissions, substitutions, and changes can be made without departing from the spirit of the invention. These embodiments and modifications of the embodiments are included in the scope and the gist of the invention and included in the inventions described in claims and the scope of equivalents of the inventions.

What is claimed is:

1. A developing device, comprising:

a housing;

a developing roller rotatably provided on an inside of the housing, including a development pole, and configured to perform development by a developer carried by a magnetic force of the development pole;

a gap forming member provided on a rotating direction downstream side of the developing roller with respect to the development pole, forming a first gap between the gap forming member and the developing roller, and forming a second gap between the gap forming member and the housing, the second gap including an upstream side opening on a rotating direction upstream side of the developing roller and a downstream side opening on a rotating direction downstream side of the developing roller, wherein a dimension of the upstream side opening in an axial direction is smaller than a dimension of the downstream side opening in the axial direction, and a relationship of 0.5≤WO/WI≤0.8 is satisfied, where WO is the dimension of the upstream side opening in an axial direction and WI is the dimension of the downstream side opening in the axial direction; and a guide section provided further on the rotating direction upstream side of the developing roller than the gap forming member and configured to direct an air current discharged from the second gap via the upstream side opening to the first gap, wherein a relationship of H1/H2<5 is satisfied, where H1 is a minimum interval between the developing roller and the gap forming member in the first gap and H2 is a minimum interval between the housing and the gap forming member in the second gap when viewed from the axial direction of the developing roller.

2. The device according to claim 1, wherein H1/R<⅔ is satisfied, where R is a radius of the developing roller.

3. The device according to claim 1 wherein WO<WI is satisfied, where WO is a dimension of the upstream side opening in the axial direction and WI is a dimension of the downstream side opening in the axial direction.

4. The device according to claim 1, wherein WI, a dimension of the downstream side opening in the axial direction, is equal to a length of the developing roller in the axial direction.

5. The device according to claim 1, wherein the first gap comprises two openings and the second gap comprises two openings.

6. The device according to claim 1, wherein

H2 is 0.5 mm or more and 5 mm or less.

7. The device according to claim 1, further comprising:

a developer storage section that stores developer having a concave shape.

8. An image forming apparatus, comprising:

an image reading section; and an image forming section comprising a developing device comprising:

a housing;

a developing roller rotatably provided on an inside of the housing, including a development pole, and configured to perform development by a developer carried by a magnetic force of the development pole;

a gap forming member provided on a rotating direction downstream side of the developing roller with respect to the development pole, forming a first gap between the gap forming member and the developing roller, and forming a second gap between the gap forming member and the housing, the second gap including an upstream side opening on a rotating direction upstream side of the developing roller and a downstream side opening on a rotating direction downstream side of the developing roller, wherein a dimension of the upstream side opening in an axial direction is smaller than a dimension of the downstream side opening in the axial direction, and 0.5≤WO/WI≤0.8 is satisfied, where WO is a dimension of the upstream side opening in the axial direction and WI is a dimension of the downstream side opening in the axial direction; and a guide section provided further on the rotating direction upstream side of the developing roller than the gap forming member and configured to direct an air current discharged from the second gap via the upstream side opening to the first gap, wherein a relationship of H1/H2<5 is satisfied, where H1 is a minimum interval between the developing roller and the gap forming member in the first gap and H2 is a minimum interval between the housing and the gap forming member in the second gap when viewed from the axial direction of the developing roller.

9. The apparatus according to claim 8, wherein H1/R<⅔ is satisfied, where R is a radius of the developing roller.

10. The apparatus according to claim 8, wherein WO<WI is satisfied, where WO is a dimension of the upstream side opening in the axial direction and WI is a dimension of the downstream side opening in the axial direction.

11. The apparatus according to claim 8, wherein WI, a dimension of the downstream side opening in the axial direction, is equal to a length of the developing roller in the axial direction.

12. The apparatus according to claim 8, wherein in the developing device:

the first gap comprises two openings and the second gap comprises two openings.

13. The device according to claim 8, wherein

H2 is 0.5 mm or more and 5 mm or less.

14. The apparatus according to claim 8, the developing device further comprises:

a developer storage section that stores developer having a concave shape.

15. A method of reducing scattering of toner outside a developing device, comprising:

developing an image formed by the developing device, the developing device comprising:

a housing;

a developing roller rotatably provided on an inside of the housing, including a development pole, and configured to perform development by a developer carried by a magnetic force of the development pole;

a gap forming member provided on a rotating direction downstream side of the developing roller with respect to the development pole, forming a first gap between the gap forming member and the developing roller, and forming a second gap between the gap forming member and the housing, the second gap including an upstream side opening on a rotating direction upstream side of the developing roller and a downstream side opening on a rotating direction downstream side of the developing roller, wherein a dimension of the upstream side opening in an axial direction is smaller than a dimension of the downstream side opening in the axial direction, and wherein a relationship of 0.5≤WO/WI≤0.8 is satisfied, where WO is the dimension of the upstream side opening in an axial direction and WI is the dimension of the downstream side opening in the axial direction; and a guide section provided further on the rotating direction upstream side of the developing roller than the gap forming member and configured to direct an air current discharged from the second gap via the upstream side opening to the first gap, wherein a relationship of H1/H2<5 is satisfied, where H1 is a minimum interval between the developing roller and the gap forming member in the first gap and H2 is a minimum interval between the housing and the gap forming member in the second gap when viewed from the axial direction of the developing roller.

16. The method according to claim 15, wherein H1/R<⅔ is satisfied, where R is a radius of the developing roller.

* * * * *